US011927123B2

(12) United States Patent
Utsunomiya

(10) Patent No.: US 11,927,123 B2
(45) Date of Patent: Mar. 12, 2024

(54) VEHICLE EXHAUST SYSTEM

(71) Applicant: TOYOTA JIDOSHA KABUSHIKI KAISHA, Toyota (JP)

(72) Inventor: Keiji Utsunomiya, Toyota (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 0 days.

(21) Appl. No.: 18/120,693

(22) Filed: Mar. 13, 2023

(65) Prior Publication Data

US 2023/0287825 A1 Sep. 14, 2023

(30) Foreign Application Priority Data

Mar. 14, 2022 (JP) ..... 2022-039105

(51) Int. Cl.
*F01N 13/14* (2010.01)
*F01N 13/08* (2010.01)

(52) U.S. Cl.
CPC ..... *F01N 13/141* (2013.01); *F01N 13/08* (2013.01); *F01N 2340/04* (2013.01); *F01N 2450/22* (2013.01); *F01N 2470/00* (2013.01); *F01N 2590/11* (2013.01)

(58) Field of Classification Search
CPC .. F01N 13/141; F01N 13/082; F01N 13/1805; F01N 2470/02
See application file for complete search history.

(56) References Cited

FOREIGN PATENT DOCUMENTS

| | | | |
|---|---|---|---|
| JP | 2010-144710 A | | 7/2010 |
| JP | 2010144710 A | * | 7/2010 |
| JP | 2018189046 A | * | 11/2018 |

OTHER PUBLICATIONS

DE102019135859A1 English Machine Translation (Year: 2020).*
JP2009085138A English Machine Translation (Year: 2010).*

* cited by examiner

*Primary Examiner* — Anthony Ayala Delgado
(74) *Attorney, Agent, or Firm* — Dinsmore & Shohl LLP

(57) ABSTRACT

A vehicle exhaust system includes an inner pipe in which exhaust gas from an internal combustion engine flows, and an outer pipe surrounding a part of the inner pipe. One end of the outer pipe is formed to have a diameter smaller than that of other portions of the outer pipe, and fixed to an outer surface of the inner pipe. A region of the outer pipe from the other end before the one end is a free region unattached to the outer surface of the inner pipe.

20 Claims, 6 Drawing Sheets

VEHICLE EXHAUST SYSTEM

CROSS REFERENCE TO RELATED APPLICATION

This application claims priority to Japanese Patent Application No. 2022-039105 filed on Mar. 14, 2022, which is incorporated herein by reference in its entirety including the specification, claims, drawings, and abstract.

TECHNICAL FIELD

The present disclosure relates to a vehicle exhaust system, in particular to a structure of an exhaust pipe portion including an outer pipe surrounding an inner pipe in which exhaust gas from an internal combustion engine flows.

BACKGROUND

There are known double-walled exhaust pipe which include an inner pipe through which exhaust gas discharged from a vehicle internal combustion engine flows, and an outer pipe surrounding the inner pipe with a gap therebetween. Patent Literature 1 (JP 2010-144710 A) discloses a structure with a double-walled exhaust pipe used to allow the exhaust gas to reach an exhaust gas purifier while maintaining a high temperature. The exhaust gas purifier includes catalyst that purifies exhaust gas. As the catalyst is activated when the exhaust gas at a high temperature passes through, the purification efficiency of exhaust gas using the catalyst can be improved.

Such a double-walled exhaust pipe can also reduce heat of exhaust gas transferred to peripheral structures around the exhaust pipe.

CITATION LIST

Patent Literature

PATENT LITERATURE 1: JP 2010-144710 A

SUMMARY

When providing an outer pipe surrounding a part of an inner pipe, the diameter of the outer pipe at both ends may be reduced to fix these ends on the outer surface of the inner pipe to thereby support the outer pipe with respect to the inner pipe. The inner pipe is likely to stretch due to thermal expansion as the temperature of the inner pipe can increase with exhaust gas flowing inside. In contrast, as the temperature of the outer pipe is unlikely to increase as compared with the inner pipe because the outer pipe is not in direct contact with exhaust gas, the outer pipe is less likely than the inner pipe to stretch due to thermal expansion. This difference in stretched lengths between the inner and outer pipes may cause detachment of the fixed portions at both ends of the outer pipe from the inner pipe.

An object of the present disclosure is to inhibit detachment of the fixed portions of the outer pipe from the inner pipe in an exhaust system with the outer pipe surrounding a part of the inner pipe.

A vehicle exhaust system mounted to a vehicle according to the present disclosure includes an inner pipe in which exhaust gas from an internal combustion engine flows, and an outer pipe surrounding a part of the inner pipe. One end of the outer pipe is formed to have a diameter smaller than that of other portions of the outer pipe, and is fixed to an outer surface of the inner pipe. A region of the outer pipe from the other end before the one end is a free region unattached to the outer surface of the inner pipe.

In the vehicle exhaust system according to the present disclosure, a slide mesh may be provided between an inner surface of the outer pipe in the free region and the outer surface of the inner pipe.

In the vehicle exhaust system according to the present disclosure, the outer pipe may be provided around the inner pipe located on a vehicle-front side of a battery pack mounted to the vehicle.

In the vehicle exhaust system according to the present disclosure, the inner pipe may include an upstream straight portion, a bent portion, and a downstream straight portion in this order from upstream to downstream of an exhaust gas flow. The one end of the outer pipe may be fixed to the outer surface of the inner pipe at a downstream side of the upstream straight portion of the inner pipe. The free region of the outer pipe may extend around the bent portion of the inner pipe and at least a part of the downstream straight portion of the inner pipe.

In the vehicle exhaust system according to the present disclosure, the inner pipe may be formed by connecting multiple inner pipe segments. The one end of the outer pipe may be positioned at a joint between two of the multiple inner pipe segments, and welded together.

The present disclosure can inhibit detachment of the fixed portion of the outer pipe from the inner pipe even when stretched lengths due to thermal expansion differ between the inner and outer pipes, because the outer pipe is fixed to the inner pipe at one side only in the direction along which the outer pipe extends.

BRIEF DESCRIPTION OF DRAWINGS

Embodiments of the present disclosure will be described based on the following figures, wherein.

DESCRIPTION OF EMBODIMENTS

Figure 1:
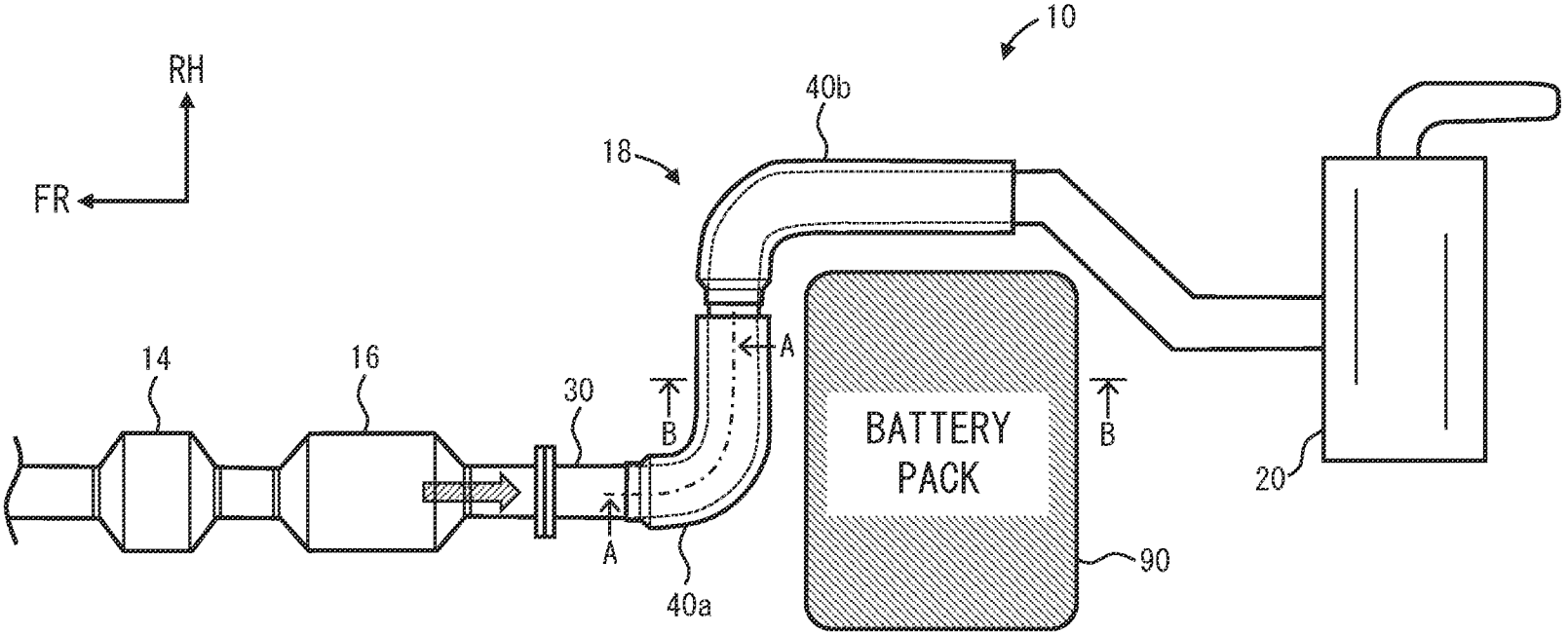
FIG. 1 is a plan view showing a vehicle exhaust system according to an embodiment of the present disclosure.

Some embodiments of the present disclosure are described below with reference to the attached drawings. The configurations described below are merely examples to facilitate descriptions and are changeable as required in accordance with, for example, the specifications of the vehicle. When two or more embodiments or variants are described below, any combinations of described features are intended to be encompassed by the present disclosure. Throughout all the drawings, the same reference numerals are assigned to the same elements, and their descriptions are not repeated.

In the drawings, arrows FR, UP, and RH are respectively directed to the front, up, and right of the vehicle. In the description below, the terms "upstream" and "downstream" are defined relative to the flow of exhaust gas from an internal combustion engine.

FIG. 1 is a plan view of an exhaust system 10 according to an embodiment of the present disclosure. FIG. 1 shows a hatched arrow which indicates the flow direction of exhaust gas. The exhaust system 10 is mounted in a hybrid vehicle, which uses an internal combustion engine and a motor (both not shown) as drive sources. The motor is driven with electric power supplied from a battery pack 90.

The gas exhausted from the internal combustion engine passes through the exhaust system 10 shown in FIG. 1 to be exhausted from the vehicle. The exhaust system 10 includes a catalytic converter 14, an additional muffler 16, a heat-damage reducing exhaust pipe portion 18, and a main muffler 20 in this order from upstream to downstream. The heat-damage reducing exhaust pipe portion 18 is the characteristic feature of the present disclosure.

To make the vehicle space compact, it is often desired to place the battery pack 90 in the vicinity of the exhaust system 10 as shown in FIG. 1. As a high temperature gas flows through the exhaust system 10, the temperature around the exhaust system 10 can be high. The heat-damage reducing exhaust pipe portion 18 is provided to reduce heat transferred from the exhaust system 10 to the battery pack 90.

Figure 2:
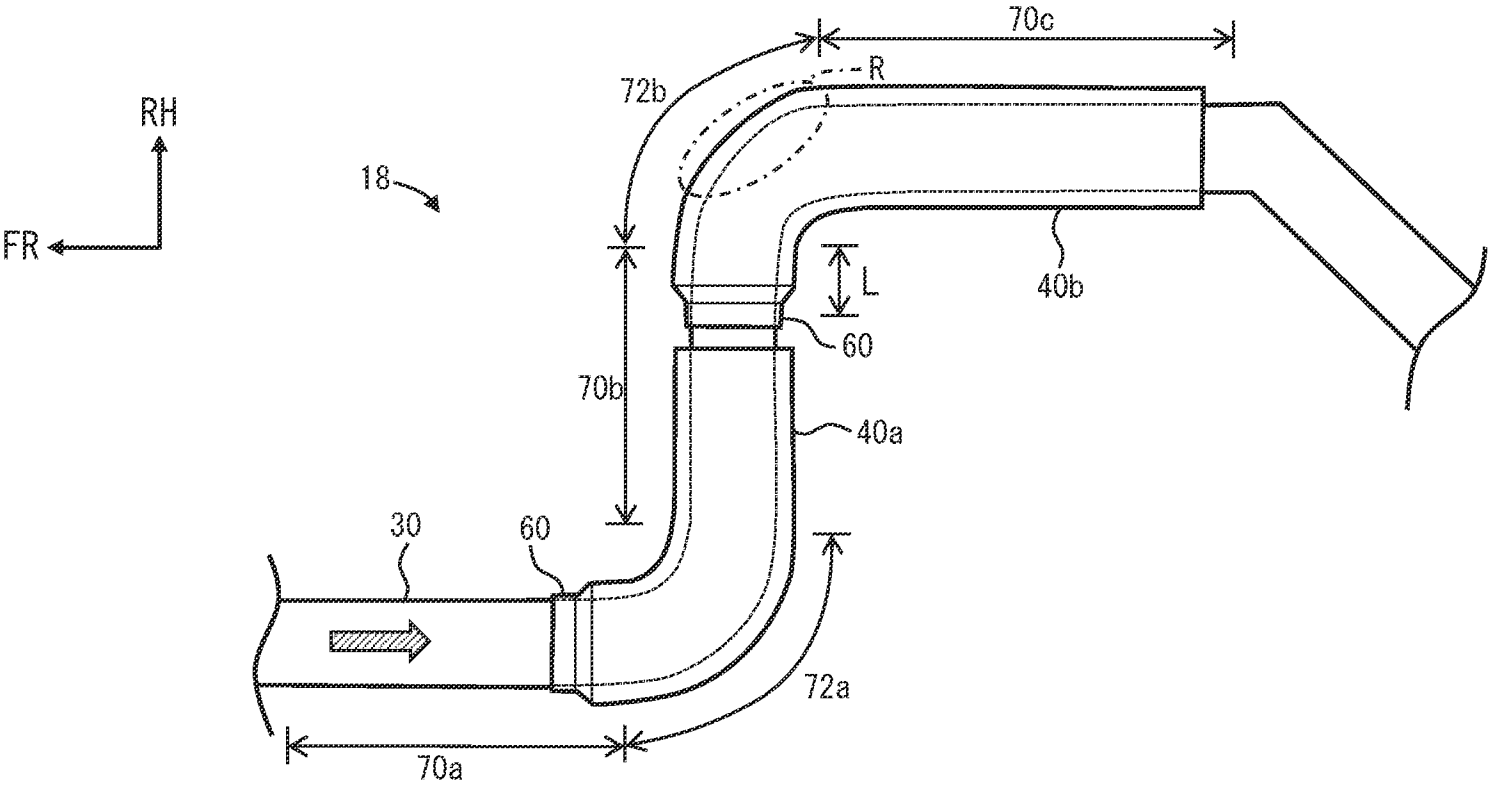
FIG. 2 is an enlarged plan view of a heat-damage reducing exhaust pipe portion.

FIG. 2 is an enlarged plan view of the heat-damage reducing exhaust pipe portion 18. This exhaust pipe portion 18 includes an inner pipe 30 through which an exhaust gas flows, and two outer pipes 40*a*, 40*b* surrounding the inner pipe 30. Each of the inner pipe 30 and the outer pipes 40*a*, 40*b* is made of stainless steel and has a cylindrical shape.

The inner pipe 30 includes a straight portion 70*a*, a bent portion 72*a*, another straight portion 70*b*, another bent portion 72*b*, and yet another straight portion 70*c*, in this order from upstream to downstream. Each of the outer pipes 40*a*, 40*b* has an L-shape. The outer pipe 40*a* is welded to the outer surface of the straight portion 70*a* and extends around the bent portion 72*a* and a part of the straight portion 70*b*. The outer pipe 40*b* is welded to the outer surface of the straight portion 70*b* and extends around the bent portion 72*b* and a part of the straight portion 70*c*. Because the outer pipes 40*a*, 40*b* and their surroundings have similar structures, the outer pipe 40*a* is described below as a representative example.

Figure 3:
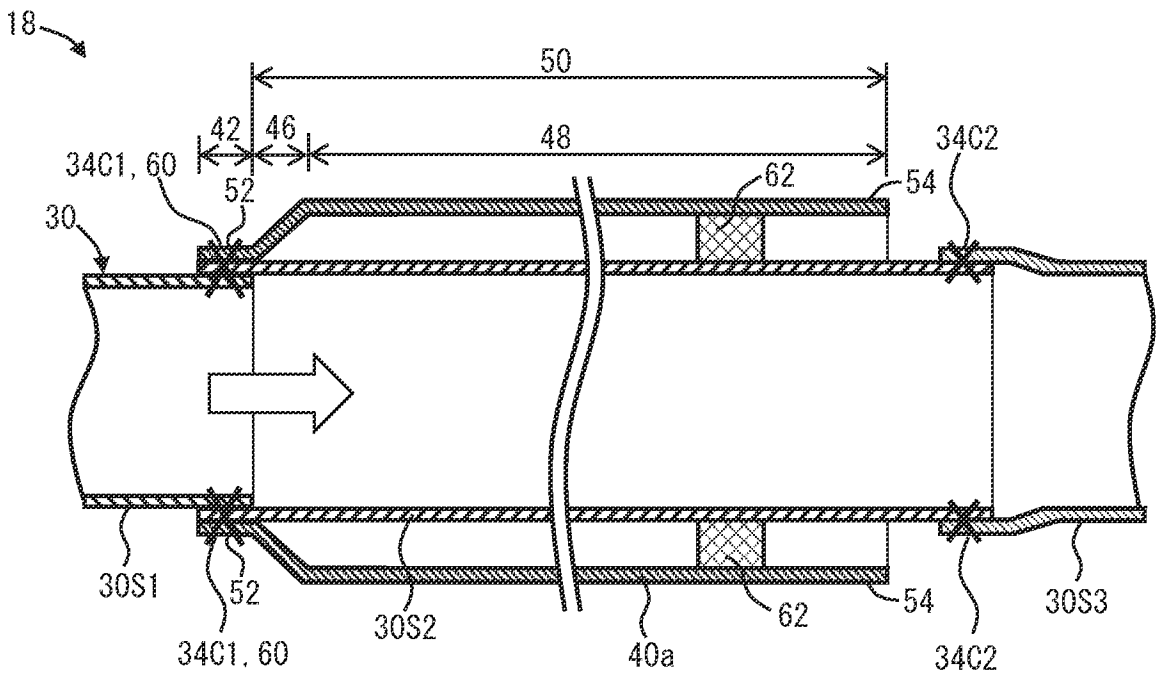
FIG. 3 is a cross section cut along line A-A in FIG. 1.

FIG. 3 is a cross section cut along line A-A in FIG. 1. The white arrow in FIG. 3 shows the flow direction of exhaust gas. As shown in FIG. 3, the inner pipe 30 is formed by connecting multiple inner pipe segments 30S1, 30S2, and 30S3. The downstream end of the inner pipe segment 30S1 and the upstream end of the inner pipe segment 30S2 are coupled, and a joint 34C1 between the two is welded. Similarly, the downstream end of the inner pipe segment 30S2 and the upstream end of the inner pipe segment 30S3 are coupled, and a joint 34C2 between the two is welded. The segments may be connected by a method other than welding at the joints 34C1, 34C2.

The outer pipe 40*a* includes a narrow region 42, a transient region 46, and a body region 48 in this order from upstream to downstream. The narrow region 42 has a diameter smaller (narrower) than the other portions of the outer pipe 40*a*, and is in contact with the outer surface of the inner pipe 30. The diameter of the transient region 46 gradually changes from upstream to downstream. The body region 48 has a constant diameter.

The narrow region 42 (an upstream end 52) of the outer pipe 40*a* is positioned at the joint 34C1 between the two inner pipe segments 30S1, 30S2, and welded together. The narrow region 42 of the outer pipe 40*a* is fixed to the outer surface of the inner pipe 30, forming a fixed portion 60. It should be noted that the number of manufacturing steps can be reduced by welding the outer pipe 40*a* and the joint 34C1 between the inner pipe segments together in a single step. The transient region 46 of the outer pipe 40*a* and the body region 48 form a free region 50 unattached to the outer surface of the inner pipe 30.

A ring-shaped slide mesh 62 may be provided between the inner surface of the free region 50 of the outer pipe 40*a* and the outer surface of the inner pipe 30. The slide mesh 62 may be a wire mesh. The slide mesh 62 may be fixed to only one of the outer surface of the inner pipe 30 and the inner surface of the outer pipe 40*a* such that the slide mesh 62 is slidable relative to the other. This enables the slide mesh 62 to move in a pipe axial direction when the stretched lengths due to thermal expansion differ between the inner pipe 30 and the outer pipe 40*a*. The slide mesh 62 supports the free region 50 of the outer pipe 40*a* with respect to the inner pipe 30.

Figure 4:
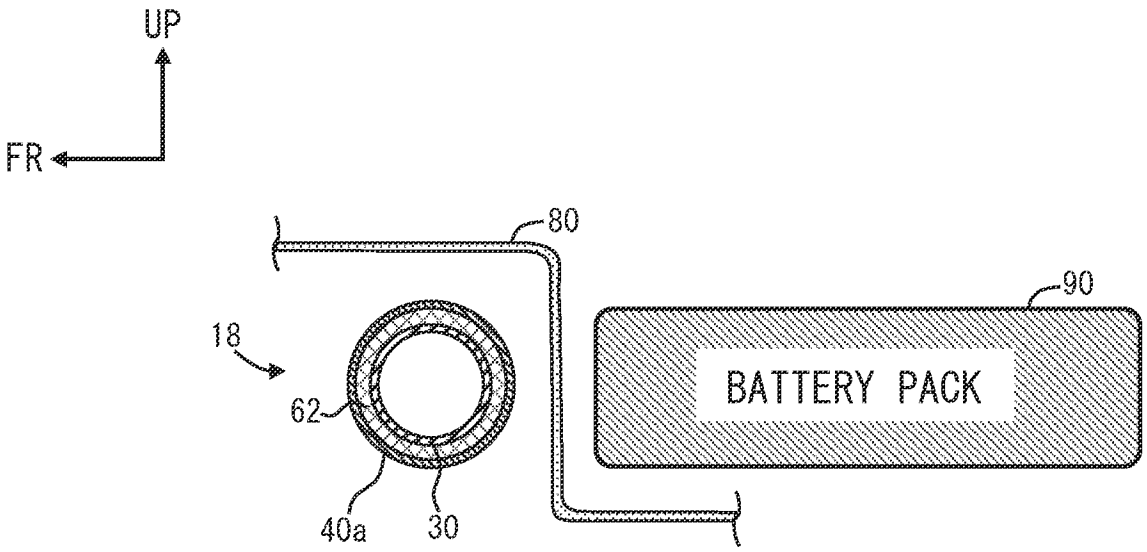
FIG. 4 is a cross section cut along line B-B in FIG. 1.

FIG. 4 is a cross section cut along line B-B in FIG. 1. A heat insulator 80 may be provided between the exhaust pipe portion 18 and the battery pack 90. The heat insulator 80 is omitted in the other drawings.

Effects of the exhaust system 10 according to the present disclosure are described below.

According to the embodiment described above, the outer pipes 40*a*, 40*b* are disposed to surround the inner pipe 30 around a portion of the exhaust system 10 located near the battery pack 90. Because convection (heat transferred through air) and radiant heat (heat transferred through infrared rays) directed to the battery pack 90 from the exhaust system 10 can thus be reduced, the ambient temperature around the battery pack 90 can be lowered. When the exhaust system 10 is located on the vehicle front side of the battery pack 90 as shown in FIG. 1, heat of the exhaust system 10 is likely to be directed to the battery pack 90 due to traveling wind of the vehicle. However, the above embodiment can effectively reduce the heat. Because the outer pipes 40*a*, 40*b* cover all around the circumference of the inner pipe 30, the heat insulation capability is high, and a heat-damage reducing effect is significant.

In the above embodiment, as shown in FIG. 3, only the upstream end 52 of the outer pipe 40*a* is fixed to the outer surface of the inner pipe 30. The region from a downstream end 54 of the outer pipe 40*a* before the fixed upstream end 52 (the transient region 46 and the body region 48) is the free region 50 unattached to the outer surface of the inner pipe 30. Accordingly, detachment of the fixed portion 60 between the outer pipe 40*a* and the inner pipe 30 can be inhibited even when the inner pipe 30 stretches more than the outer pipe 40*a* (causing a difference in stretched lengths) due to thermal expansion caused by the hot exhaust gas flowing therethrough.

With the above embodiment, because the space between the outer pipe 40*a* and the inner pipe 30 is not in communication with the interior of the inner pipe 30, even if substances such as water enter into the space, they cannot flow into the inner pipe 30. For example, in a variant of the structure of the exhaust pipe portion 18 shown in FIG. 3, the inner pipe segment 30S2 and the inner pipe segment 30S3 may be disposed with a gap therebetween, and the downstream end 54 of the outer pipe 40*a* may be connected to the inner pipe segment 30S3 such that the space between the outer pipe 40*a* and the inner pipe 30 is in communication with the interior of the inner pipe 30. However, in this variant structure, water generated through combustion of fuel by the internal combustion engine may accumulate in the space between the outer pipe 40*a* and the inner pipe 30, flow to a downstream portion of the inner pipe 30, and then freeze. This incurs a risk of clogging of the inner pipe 30. However, such a risk can be eliminated by the structure of the above embodiment in which the space between the outer pipe 40*a* and the inner pipe 30 is independent from the interior of the inner pipe 30.

In the above embodiment, as shown in FIG. 2, the outer pipe 40*a* is fixed at the downstream side of the straight portion 70*a* of the inner pipe 30, and the outer pipe 40*b* is fixed at the downstream side of the straight portion 70*b*. It should be noted that the downstream side of the straight portion 70*a* indicates a downstream half region of the whole straight portion 70*a*. The downstream side of the straight portion 70*b* is similarly defined. Such a structure can prevent the outer surface of the bent portions 72*a*, 72*b* of the inner pipe 30 from coming into contact with the inner surface of the outer pipes 40*a*, 40*b* when the inner pipe 30 inside the outer pipes 40*a*, 40*b* stretches due to thermal expansion. This is described below using the outer pipe 40*b* as an example.

As shown in FIG. 2, the upstream end of the outer pipe 40*b* is fixed at a downstream side of the straight portion 70*b* (upstream straight portion) such that distance L from the fixed portion 60 to the bent portion 72*b* is short. The free region of the outer pipe 40*b* extends around the bent portion 72*b* and a part of the straight portion 70*c* (downstream straight portion).

Figure 6:
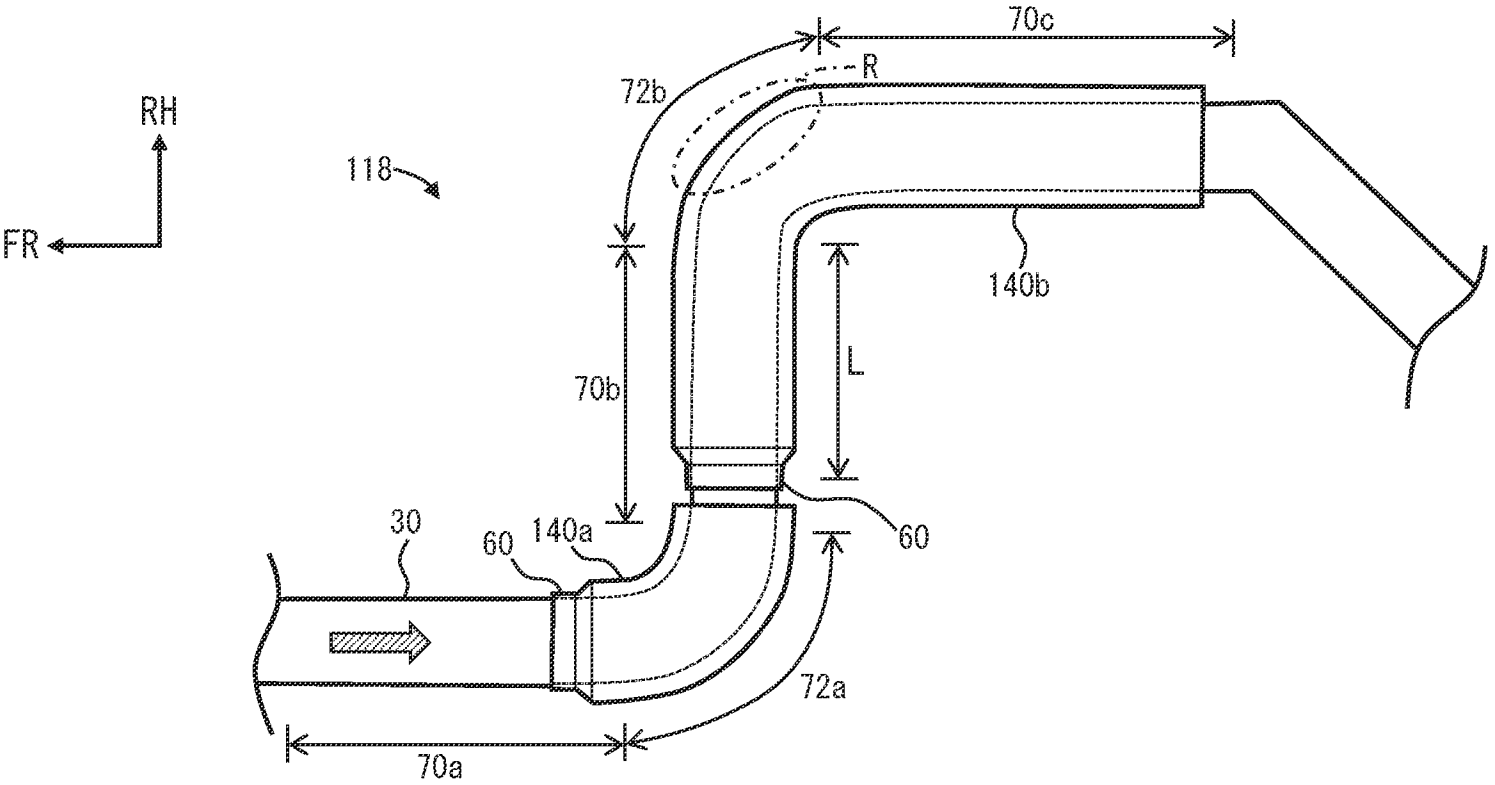
FIG. 6 is a plan view of a heat-damage reducing exhaust pipe portion according to a comparative technology.

FIG. 6 is a plan view of another exhaust pipe portion 118 according to a comparative technology. In this comparative technology, a short outer pipe 140*a* is disposed on the upstream side and a long outer pipe 140*b* (corresponding to the outer pipe 40*b* in FIG. 2) is disposed on the downstream side. The upstream end of the 140*b* is fixed at the upstream side of the straight portion 70*b* (in the upstream half region of the whole straight portion 70*b*) such that distance L from the fixed portion 60 to the bent portion 72*b* is long.

As shown in FIG. 6, if distance L is long, as the stretch length of the inner pipe 30 due to thermal expansion from the fixed portion 60 to the bent portion 72*b* may be longer, the outer surface of the inner pipe 30 is more likely to come into contact with the inner surface of the outer pipe 140*b* at point R in FIG. 6. If the outer surface of the inner pipe 30 comes into contact with the inner surface of the outer pipe 140*b*, the fixed portion 60 of the outer pipe 140*b* may be detached because of shear stress applied to the fixed portion 60. In contrast, when distance L is short as shown in FIG. 2, as the stretch length of the inner pipe 30 due to thermal expansion from the fixed portion 60 to the bent portion 72*b* can be shorter, the outer surface of the inner pipe 30 is less likely to come into contact with the inner surface of the outer pipe 40*b*. As such, it is significantly useful to fix the outer pipe 40*b* at the downstream side of the straight portion 70*b* of the inner pipe 30 to shorten distance L. Even in the embodiment shown in FIG. 6, no issues occur if some measures are taken, such as allowing a long interval between the inner pipe 30 and the outer pipe 140*b* around area R. Embodiments such as the one shown in FIG. 6 are thus not excluded from the scope of the present disclosure.

Figure 5:
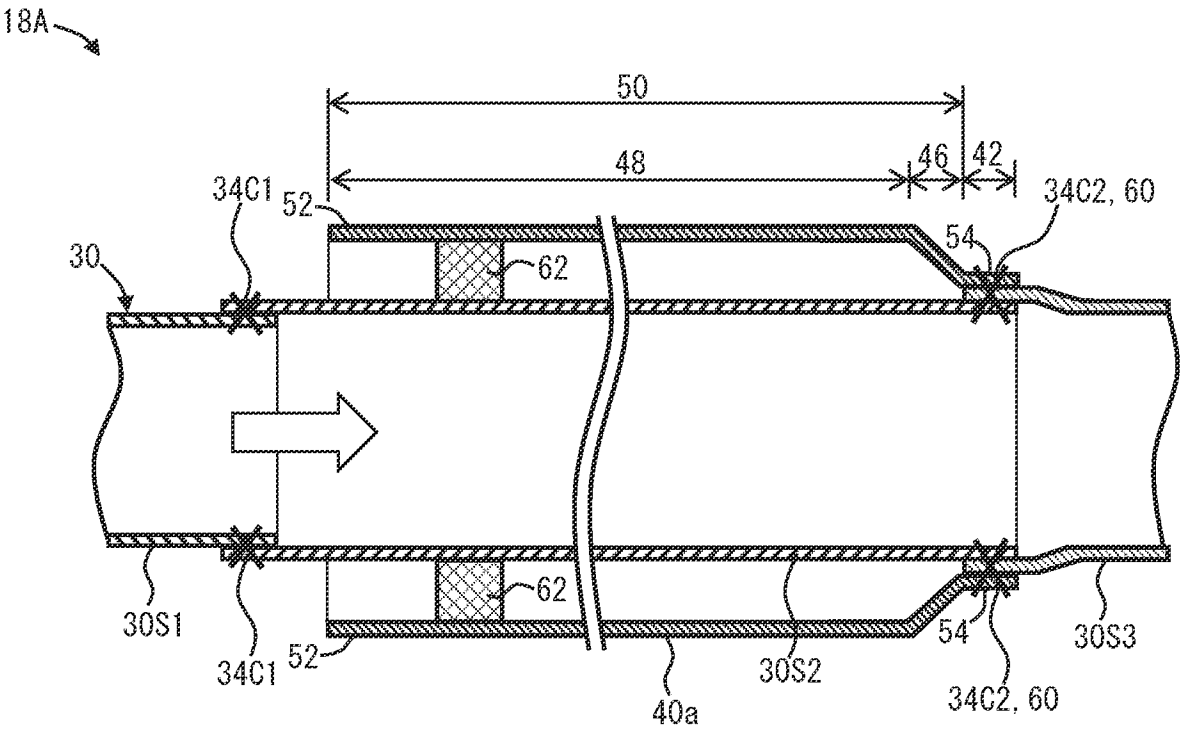
FIG. 5 is a partial cross section of a heat-damage reducing exhaust pipe portion according to another embodiment of the present disclosure.

Variations of the present disclosure are described below. In the above embodiments, as shown in FIG. 3, the upstream end 52 of the outer pipe 40*a* is fixed on the outer surface of the inner pipe 30, and the region of the outer pipe 40*a* from the downstream end 54 before the fixed upstream end 52 is the free region 50. However, as shown in FIG. 5, the downstream end 54 of the outer pipe 40*a* may be fixed on the outer surface of the inner pipe 30, and the region of the outer pipe 40*a* from the upstream end 52 before the fixed downstream end 54 may be the free region 50 (exhaust pipe portion 18A).

Further, in the embodiment describe above, the heat-damage reducing exhaust pipe portion 18 is provided for the battery pack 90. However, the heat-damage reducing exhaust pipe portion 18 may be provided for other components, such as a fuel tank.

In the above embodiment, the inner pipe 30 and the outer pipe 40*a* (or outer pipe 40*b*) surrounding the inner pipe 30 are used as the double-walled exhaust pipe. However, triple or more walled exhaust pipe may be used by disposing two or more outer pipes around the inner pipe 30 with annular gaps therebetween.

The invention claimed is:

1. A vehicle exhaust system mounted to a vehicle, comprising:

an inner pipe in which exhaust gas from an internal combustion engine flows; and an outer pipe surrounding a part of the inner pipe, wherein one end of the outer pipe is formed to have a diameter smaller than that of other portions of the outer pipe, and is fixed to an outer surface of the inner pipe, a region of the outer pipe from the other end before the one end is a free region unattached to the outer surface of the inner pipe, and the inner pipe is formed by connecting a plurality of inner pipe segments.

2. The vehicle exhaust system according to claim 1, wherein a slide mesh is provided between an inner surface of the outer pipe in the free region and the outer surface of the inner pipe.

3. The vehicle exhaust system according to claim 2, wherein the outer pipe is provided around the inner pipe located on a vehicle-front side of a battery pack mounted to the vehicle.

4. The vehicle exhaust system according to claim 3, wherein the inner pipe comprises an upstream straight portion, a bent portion, and a downstream straight portion in this order from upstream to downstream of an exhaust gas flow, the one end of the outer pipe is fixed to the outer surface of the inner pipe at a downstream side of the upstream straight portion of the inner pipe, and the free region of the outer pipe extends around the bent portion of the inner pipe and at least a part of the downstream straight portion of the inner pipe.

5. The vehicle exhaust system according to claim 4, wherein the one end of the outer pipe is positioned at a joint between two of the plurality of inner pipe segments, and welded together.

6. The vehicle exhaust system according to claim 3, wherein the one end of the outer pipe is positioned at a joint between two of the plurality of inner pipe segments, and welded together.

7. The vehicle exhaust system according to claim 2, wherein the inner pipe comprises an upstream straight portion, a bent portion, and a downstream straight portion in this order from upstream to downstream of an exhaust gas flow, the one end of the outer pipe is fixed to the outer surface of the inner pipe at a downstream side of the upstream straight portion of the inner pipe, and the free region of the outer pipe extends around the bent portion of the inner pipe and at least a part of the downstream straight portion of the inner pipe.

8. The vehicle exhaust system according to claim 7, wherein the one end of the outer pipe is positioned at a joint between two of the plurality of inner pipe segments, and welded together.

9. The vehicle exhaust system according to claim 2, wherein the one end of the outer pipe is positioned at a joint between two of the plurality of inner pipe segments, and welded together.

10. The vehicle exhaust system according to claim 1, wherein the outer pipe is provided around the inner pipe located on a vehicle-front side of a battery pack mounted to the vehicle.

11. The vehicle exhaust system according to claim 10, wherein the inner pipe comprises an upstream straight portion, a bent portion, and a downstream straight portion in this order from upstream to downstream of an exhaust gas flow, the one end of the outer pipe is fixed to the outer surface of the inner pipe at a downstream side of the upstream straight portion of the inner pipe, and the free region of the outer pipe extends around the bent portion of the inner pipe and at least a part of the downstream straight portion of the inner pipe.

12. The vehicle exhaust system according to claim 11, wherein the one end of the outer pipe is positioned at a joint between two of the plurality of inner pipe segments, and welded together.

13. The vehicle exhaust system according to claim 10, wherein the one end of the outer pipe is positioned at a joint between two of the plurality of inner pipe segments, and welded together.

14. The vehicle exhaust system according to claim 1, wherein the inner pipe comprises an upstream straight portion, a bent portion, and a downstream straight portion in this order from upstream to downstream of an exhaust gas flow, the one end of the outer pipe is fixed to the outer surface of the inner pipe at a downstream side of the upstream straight portion of the inner pipe, and the free region of the outer pipe extends around the bent portion of the inner pipe and at least a part of the downstream straight portion of the inner pipe.

15. The vehicle exhaust system according to claim 14, wherein the one end of the outer pipe is positioned at a joint between two of the plurality of inner pipe segments, and welded together.

16. The vehicle exhaust system according to claim 1, wherein the one end of the outer pipe is positioned at a joint between two of the plurality of inner pipe segments, and welded together.

17. The vehicle exhaust system according to claim 1, wherein the outer pipe has an L-shape.

18. A vehicle exhaust system mounted to a vehicle, comprising:

an inner pipe in which exhaust gas from an internal combustion engine flows, the inner pipe includes a first inner pipe end and an opposite second inner pipe end; and an outer pipe surrounding a part of the inner pipe, the outer pipe includes a first outer pipe end and an opposite second outer pipe end, wherein the first outer pipe end of the outer pipe is formed to have a diameter smaller than that of other portions of the outer pipe, and the first outer pipe end is fixed to an outer surface of the inner pipe adjacent the first inner pipe end, a region of the outer pipe from a second outer pipe end before the first outer pipe end is a free region unattached to the outer surface of the inner pipe, and the second inner pipe end extends beyond the second outer pipe end.

19. The vehicle exhaust system according to claim 18, wherein the inner pipe is formed by connecting a plurality of inner pipe segments.

20. The vehicle exhaust system according to claim 18, wherein the outer pipe has an L-shape.

* * * * *